US008786194B2

(12) United States Patent
Shin

(10) Patent No.: US 8,786,194 B2
(45) Date of Patent: Jul. 22, 2014

(54) CONSTANT CURRENT DRIVING APPARATUS FOR LEDS

(76) Inventor: Bong Sub Shin, Anyang (KR)

( * ) Notice: Subject to any disclaimer, the term of this patent is extended or adjusted under 35 U.S.C. 154(b) by 163 days.

(21) Appl. No.: 13/575,946

(22) PCT Filed: Jan. 11, 2011

(86) PCT No.: PCT/KR2011/000166
§ 371 (c)(1),
(2), (4) Date: Jul. 28, 2012

(87) PCT Pub. No.: WO2011/096649
PCT Pub. Date: Aug. 11, 2011

(65) Prior Publication Data

US 2012/0299484 A1 Nov. 29, 2012

(30) Foreign Application Priority Data

Feb. 5, 2010 (KR) ..... 10-2010-0010970

(51) Int. Cl.
*H05B 37/02* (2006.01)

(52) U.S. Cl.
USPC ..... 315/122; 315/192; 315/297; 315/185 R; 315/185 S

(58) Field of Classification Search
USPC ..... 315/122, 192, 185 R, 185 S, 127, 186, 315/193, 200 A, 312, 323
See application file for complete search history.

(56) References Cited

U.S. PATENT DOCUMENTS

| | | | | |
|---|---|---|---|---|
| 7,081,722 | B1 * | 7/2006 | Huynh et al. | 315/323 |
| 7,439,944 | B2 * | 10/2008 | Huynh et al. | 345/82 |
| 8,299,724 | B2 * | 10/2012 | Huynh | 315/291 |
| 8,410,717 | B2 * | 4/2013 | Shteynberg et al. | 315/291 |
| 8,456,095 | B2 * | 6/2013 | Huynh | 315/209 R |
| 8,569,956 | B2 * | 10/2013 | Shteynberg et al. | 315/123 |

FOREIGN PATENT DOCUMENTS

| | | | |
|---|---|---|---|
| JP | 2005-310997 | A | 11/2005 |
| JP | 2007-242427 | A | 9/2007 |
| KR | 1020060091504 | A | 8/2006 |
| KR | 100628719 | B1 | 9/2006 |
| KR | 10-2007-0046696 | A | 5/2007 |
| KR | 10-2008-0106234 | A | 12/2008 |
| KR | 10-2009-0076330 | A | 7/2009 |
| KR | 10-0916850 | B1 | 9/2009 |

* cited by examiner

*Primary Examiner* — Vibol Tan
(74) *Attorney, Agent, or Firm* — Patent Office of Dr. Chung Park

(57) ABSTRACT

An LED constant current driving apparatus includes a power supply module; an LED module comprising one or more LEDs connected in serial, the LED module that is luminous by the power supplied by the power supply module; a current detection module connected to an output terminal of the LED module, to detect a current flowing to the LED module; an error amplification module configured to compare the current signal detected by the current detection module to a first preset signal and to amplify and output an error signal base on the result of the comparison; and a plurality of sequential driving control modules connected to the one or more LEDs provided in the LED module in serial, to compare the error signal amplified and outputted by the error amplification module to a second preset reference and to control luminosity and off driving of each LED of the LED module.

6 Claims, 3 Drawing Sheets

CONSTANT CURRENT DRIVING APPARATUS FOR LEDS

CROSS-REFERENCE TO PRIOR APPLICATIONS

This application is a national Stage Patent Application of PCT International Patent Application No. PCT/KR2011/000166, filed on Jan. 11, 2011 under 35 U.S.C. §371, which claims priority of a Korean Patent Application No. 10-2010-0010970, filed on Feb. 5, 2010, which are all hereby incorporated by reference in their entirety.

TECHNICAL FIELD

Embodiments of the present invention may relate to a constant current driving apparatus for a light emitting diode (LED) (hereinafter, an LED constant current driving apparatus).

BACKGROUND

Generally, an LED is eco-friendly and a response speed of the LED is a nanosecond. The LED is able to respond rapidly and it is effective in a video signal stream. The driving of the LED can be impulsive and color reproduction of the LED is 100% or more. Brightness, a color and the temperature thereof may be freely changed by adjusting the radiation intensity of red, green and blue LEDs. Such the LED has advantages that are proper to make a liquid crystal display (LCD) panel light, thin, short and small. Accordingly, the LED has been utilized as a light source for a backlight of such a LCD panel in recent.

In addition, a plurality of LEDs are connected with each other to enlarge the output from a lighting apparatus using a LED. In this instance, voltages more than the total voltages gained by adding up forward driving voltages of LEDs connected in serial have to be supplied, to drive the plurality of the connected LEDs.

In the lighting apparatus using the plurality of the LEDS, an electric voltage using switching mode power supply (SMPS) is used to drive the lighting apparatus at a broad range of voltages.

However, a conventional LED driving apparatus using the SMPS uses high speed switching and much noise might be generated. Accordingly, the conventional LED driving apparatus requires a noise filter and is uses many parts for circuit formation. It is difficult to form a circuit with a low production cost.

In addition, the conventional LED driving apparatus uses an electrolytic condenser and it is inappropriate for a long life space of usage. Most of LED lighting apparatuses include a LED for emit a light and a circuit. The heat generated by the luminosity of the LEDs might shorten the life span of the electrolytic condenser disadvantageously.

Voltages more than the voltages or more gained by adding forward operating voltages of the LEDs have to be supplied to drive the lighting apparatus having the plurality of the LEDs connected with each other. Accordingly, it is difficult in environments having large variation of the input voltages to provide a high power factor LED lighting apparatus.

DISCLOSURE

Technical Problem

To solve the problems, an object of the present invention is to provide a LED constant current driving apparatus that is able to perform driving of LEDs according to the size of an input size when driving a plurality of LEDS connected in serial.

Another object of the present invention is to provide a LED constant current driving apparatus that is able to perform driving of LEDs by controlling a predetermined number of LEDs supplied currents at a low input voltage to be luminous and the other LEDs to be off, to perform LED driving with using a variation range of input voltage.

Technical Solution

To achieve these objects and other advantages and in accordance with the purpose of the embodiments, as embodied and broadly described herein, a LED constant current driving apparatus includes a power supply module configured to supply an electric power; a LED module comprising one or more LEDs connected in serial, the LED module that is luminous by the power supplied by the power supply module; a current detection module connected to an output terminal of the LED module, to detect a current flowing to the LED module; an error amplification module configured to compare the current signal detected by the current detection module with a first preset signal and to amplify and output an error signal base on the result of the comparison; and a plurality of sequential driving control modules connected with the one or more LEDs provided in the LED module in serial, to compare the error signal amplified and outputted by the error amplification module with a second preset reference and to control luminosity and off driving of each LED provided in the LED module connected therewith by generating a sequential driving control signal based on the result of the comparison.

The plurality of the sequential driving control modules may control driving of a specific LED by generating a sequential driving control signal for flowing an electric current to both ends of a specific LED provided in the LED module connected therewith, when the error signal amplified and outputted by the error amplification module is over the second preset reference signal, and the plurality of the sequential driving control modules may control driving of a specific LED by generating a sequential driving control signal for flowing no electric current to both ends of a specific LED of the LED module connected therewith, when the error signal amplified and outputted by the error amplification module is less than the second reference signal.

The plurality of the sequential driving control modules may be connected with the other LEDs except a predetermined number of LEDs capable of being luminous by the minimum voltage of the power supplied by the power supply module. Regardless of the luminosity or off driving performed by the sequential driving control modules, the predetermined number of the LEDs not connected with the sequential driving control modules may be maintained to be luminous until the power supplied by the power supply module is stopped. The number of the sequential driving control modules may be freely adjustable according to setting the maximum voltage and the minimum voltage of the power supplied by the power supply module.

The current detection module may be configured of a resistance a resistance connected with an output terminal of the LED module, and the error amplification module may be configured of a comparator having an inverting terminal (−) connected with an output terminal of the current detection module and a non-inverting terminal (+) connected with a first reference signal, and the sequential driving control modules may be configured of a plurality of comparators having non-inverting terminals (+) connected with an output terminal of the error amplification module and inverting terminals (−) connected with a second reference signal; a plurality of resistances for adjusting a voltage of the second reference signal connected with the inverting terminal (−) of the comparators; and a plurality of filed effect transistors (FET) having gate terminals connected with output terminals of the comparators, drain terminals connected with anodes of LEDs provided in the LED module, respectively, and source terminals provided in serial to be connected with an output terminal of the LED module.

In another aspect of the present invention, a LED constant current driving apparatus includes a power supply module configured to supply an electric power; a LED module comprising one or LEDs connected in serial, the LED module that is luminous by the power supplied by the power supply module; a current detection module connected to an output terminal of the LED module, to detect a current flowing to the LED module; an error amplification module configured of a transistor having a base terminal connected with an output terminal of the current detection module, an emitter terminal connected with the power supply module, a collector terminal connected with a sequential driving control module, to amplify and output a current signal detected by the current detection module when a current signal detected by the current detection module is over a reference voltage of the transistor; and a plurality of sequential driving control modules configured of a plurality of transistors having a base terminal connected with an output terminal of the error amplification module and a collector terminal connected with an anode of each LED provided in the LED module, to make a specific LED luminous by controlling a current to flow to both ends of a specific LED provided in the LED module when a voltage supplied to a base terminal of each transistor according to the current amplified and outputted by the error amplification module is lower than a reference voltage of each transistor and to switch off a specific LED by controlling a current flowing to both ends of a specific LED to be cut off when a voltage supplied to a base terminal of each transistor according to the current amplified and outputted by the error amplification module is over a reference voltage of each transistor.

Advantageous Effects

The embodiments have following advantageous effects. According to the LED constant current driving apparatus, only the predetermined number of LEDs capable of being supplied the current when driving the plurality of LEDs connected in serial are controlled to be luminous and the other LEDS are controlled sequentially according to the size of the flowing current. Accordingly, the LED constant current driving apparatus may perform the LED driving, with using a variation range of an input voltage, and it may form a high power factor lighting apparatus at a circuit using a sine wave power. Not using a conventional electrolytic condenser, the LED constant current driving apparatus may enhance a life span of a lighting apparatus and simplify a circuit. Accordingly, a low-priced lighting apparatus may be fabricated advantageously.

Furthermore, when driving a plurality of LEDs connected in serial by using a battery, a variation range of a power voltage may be used broadly and the plurality of LEDs can be driven until the battery is discharged.

BEST MODE

Referring to the accompanying drawings, an LED constant current driving apparatus according to one embodiment of the present invention in detail as follows.

Figure 1:
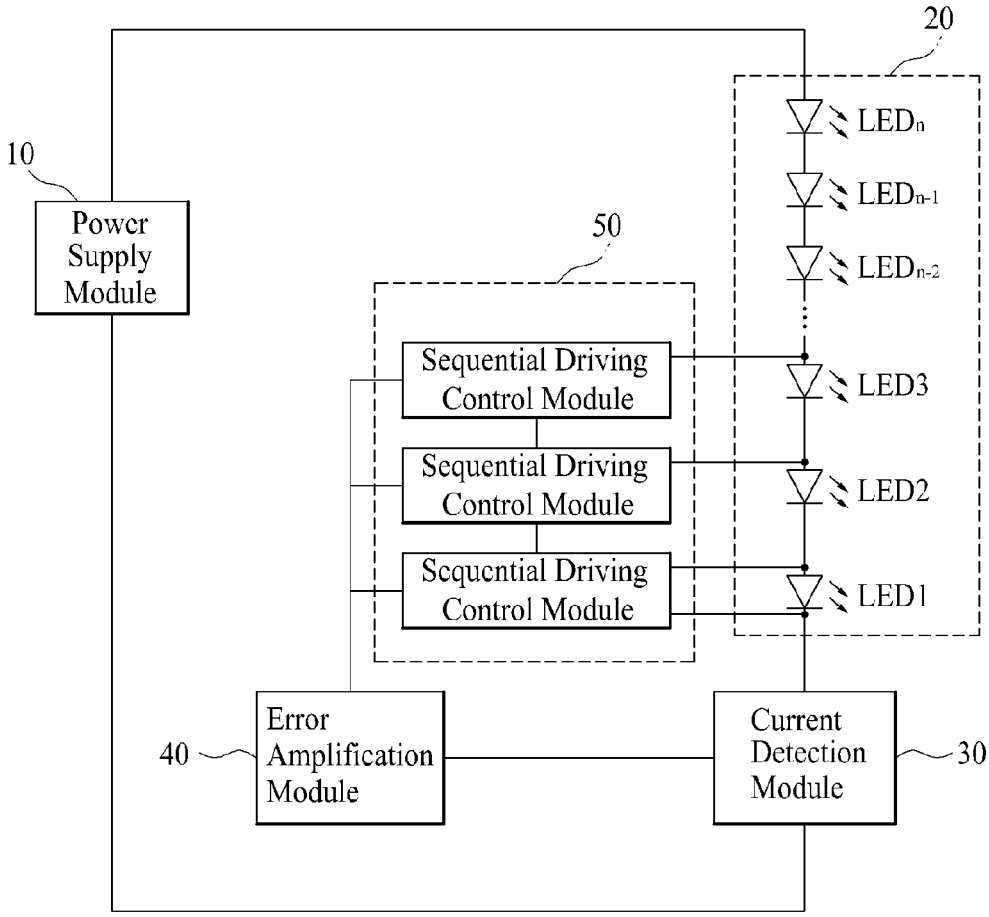
FIG. 1 is a block view schematically illustrating a configuration of a LED constant current driving apparatus according to an embodiment of the present invention.

FIG. 1 is a block view schematically illustrating a configuration of a LED constant current driving apparatus according to an embodiment of the present invention.

As shown in FIG. 1, a LED constant current driving apparatus includes a power supply module 10, an LED module 20, a current detection module 30, an error amplification module 40 and a plurality of sequential driving control module 50.

The power supply module 10 supplies to the electric power to the LED module 20 to make luminous each of LEDs connected with each other in serial.

The LED module 20 includes one or more LEDs (LED1~LEDn) connected with each other in serial and it emits light by using the power supplied by the power supply module 10. In this instance, a plurality of LEDs are grouped to be a single LED. For example, if a driving voltage (Vf) of a single LED is 3.2V, a single LED is shown on the circuit configuration and a 9.6V LED configured of three LEDs may be used.

The current detection module 30 is connected to an output end of the LED module 20. The current detection module detects currents flowing to the LED module 20 and it outputs the detected currents to the error amplification module 40.

The error amplification module 40 compares the current signal detected by the current detection module 30 with a first preset reference signal. The error amplification module 40 amplifies and outputs an error signal based on the result of the comparison to the plurality of sequential driving control modules 50.

The plurality of the sequential driving control modules 50 may be connected with one or more LEDs provided in the LED module 10 connected in serial (FIG. 1 shows that the sequential driving control module 50 is provided between LED1, LED2 and LED3 and alternatively, the sequential driving control unit 50 may be connected to both ends of LEDs, respectively) and the plurality of the sequential driving control modules 50 compare with an error signal amplified and outputted from the error amplification module 40 with a second preset reference signal, to generate a sequential driving control signal based on the result of the comparison. Hence, the sequential driving control modules 50 may control light emitting or off of each LED provided in the LED module 20 connected thereto based on the sequential driving control signal.

At this time, when the error signal amplified and outputted from the error amplification module 40 is over the second reference signal, the sequential driving control modules 50 generates the sequential driving control signals for enabling electric currents to flow to both ends of a specific LED of the LED module 20 connected thereto and they control the light emitting driving of the corresponding LED. When the amplified and outputted error signal is less than the second reference signal, the sequential driving control modules 50 generates a sequential driving control signal for enabling electric currents not to flow both ends of a specific LED of the LED module 20 connected thereto and they control the off driving of the corresponding LED. In other words, the sequential driving control modules 40 may drive a predetermined amount of LEDs capable of flowing currents required to drive the LEDs according to the size of the electric power supplied by the power supply module 10 and cut off the driving of the other LEDs not capable of flowing currents required to drive the LEDs.

In addition, the sequential driving control module may control the other LEDs that are connected with the other LEDs, except the predetermined amount of the LEDs capable of being luminous by the minimum voltage of the electric power supplied by the power supply module 10. Regardless of the light emitting driving or off driving controlled by the sequential driving control modules 50, the sequential driving control modules 50 may not be connected with the predetermined LEDs of the LED module 20 and they may control the predetermined LEDs not connected thereto to be luminous until the power supplied by the power supply module 10 is stopped. The number of the sequential driving control modules 50 may be configured to be adjustable according to the maximum voltage or the minimum voltage of the power supplied by the power supply module 10 (it is preferred that the number of the sequential driving control modules 50 may be adjustable in a state of maintaining a power factor of the Led lighting apparatus 90% or more).

For example, if it is assumed that a LED lighting apparatus provider connects twelve LEDs in serial that perform light-emitting via 10V voltages to set the maximum voltage to be 120V and the minimum voltage of the power supplied by the power supply module 10V to be 60V, the sequential driving control modules 50 are connected with both ends of the other LEDs, respectively, except six LEDs that are the number of the LEDs capable being luminous by the minimum voltage of the power supplied by the power supply module 10. The other corresponding LEDs are luminous or off based on the control of the sequential driving control modules 50 performed according to the size of the power supplied by the power supply module 10.

The driving of the LED constant current driving apparatus shown in FIG. 1 having the configuration mentioned above will be described in detail as follows.

Unless the power required to drive all of the LEDs (LED1~LEDn) composing the LED module 20 is supplied by the power supply module 10, only a predetermined amount of LEDs composing the LED module 20 are luminous.

In other words, the error signal with respect to the first preset reference signal is amplified and outputted by the error amplification module 40 based on the currents detected by the current detection module 30. The output signal is compared with the preset second reference signal by the sequential driving control modules 50 to identify that sufficient voltages are not supplied to the LED module 20 by the power supply module 10 based on the result of the comparison. The power is controlled not to be supplied to LED1~LED3 of the LED module 20. Accordingly, the LED1~LED3 of the LED module 20 may be off and the other LEDs may be luminous.

In that state, when the power supplied by the power supply module 10 is increased, the currents flowing to the LED module 20 are increased and the current signal detected by the current detection module 30 is amplified by the error amplification module 40. After that, the amplified signal is output to the plurality of the sequential driving control modules 50. When the signal amplified by the error amplification module 40 is over the second preset reference signal (in other words, in a state of supplying sufficient currents required to make specific LEDs of the LED module 20 luminous), the sequential driving control module 50 controls the specific LEDs connected thereto to be luminous by supplying the power. In other words, when the electric voltages supplied to the LED module 20 by the power supply module 10 are heightened, the electric voltages are controlled to be supplied to LED3, LED2 and LED 1 connected with the sequential driving control module 50 according to the heightened voltages and LED3, LED2 and LED 1 are sequentially luminous.

In contrast, when the electric voltages supplied to the LED module 20 by the power supply module 10 are lowered, the electric voltages are controlled not to be supplied to LED1, LED2 and LED3 connected with the sequential driving control module 50 according to the lowered voltages and LED1, LED2 and LED3 are sequentially off.

Based on such the controlling method, the LEDs connected with the sequential driving control module 50 may be sequentially luminous or off according to the voltages supplied to the LED module 20 by the power supply module 10. Accordingly, the predetermined number of the LEDs supplied driving currents may be driven even by low input voltages and the other LEDs are cut off. A variation range of input voltages may be used as broadly as possible.

Figure 2:
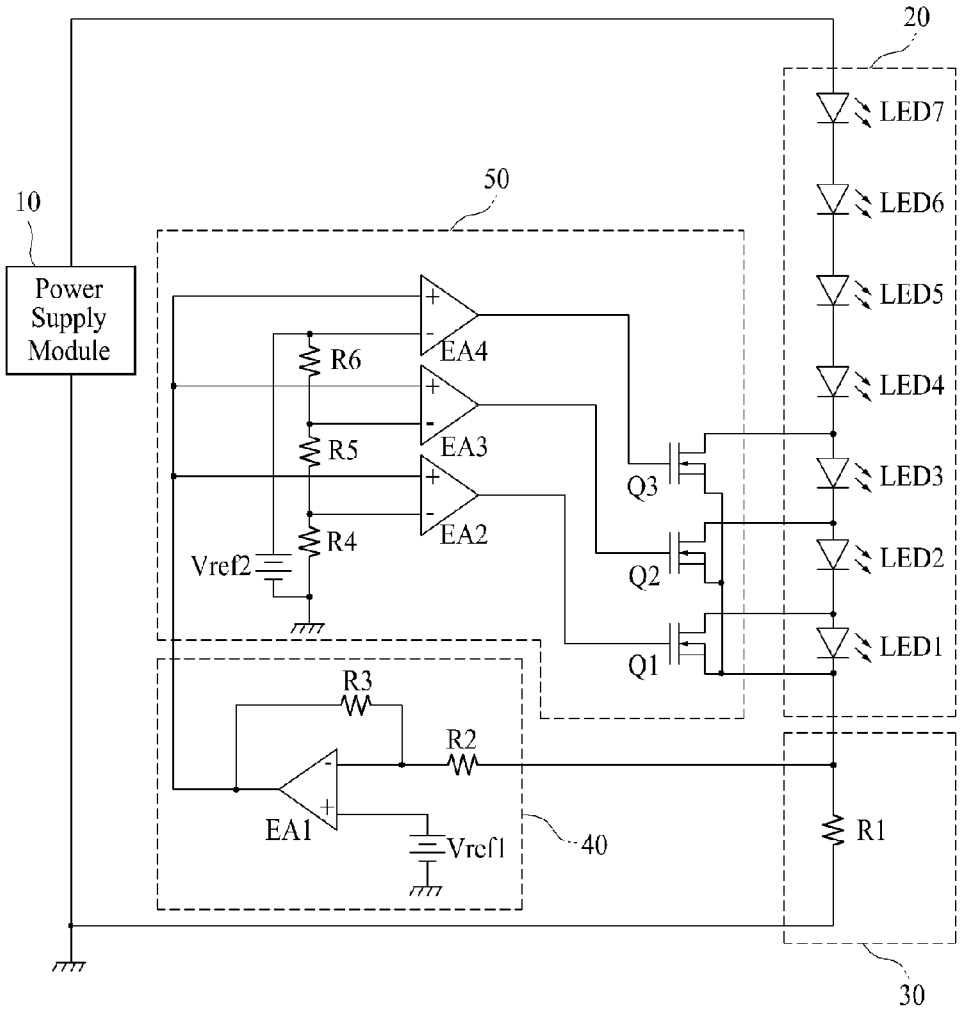
FIGS. 2 and 3 are diagrams illustrating a specific circuit of the LED constant current driving apparatus according to the embodiment of the present invention.

FIG. 2 is a diagram of a circuit illustrating the LED constant current driving apparatus according to the embodiment of the present invention. The current detection module 30 is configured of a resistance (R1) connected to an output terminal of the LED module 20 having the plurality of LEDs (LED1~LED7) connected in serial. The error amplification module 40 is configured of a comparator (EA1) having an inverting terminal (−) connected with an output terminal of the current detection module 30 via a resistance R2) and a non-inverting terminal (+) connected with a first reference signal (Vref1). The sequential driving control modules 50 are configured of a plurality of comparators (EA2~EA4) having non-inverting terminals (+) connected with an output terminal of the error amplification module 40 and inverting terminals (−) connected with a second reference signal (Vref2), a plurality of resistances (R4~R6) for adjusting a voltage of the second reference signal (Vref2) connected with the inverting terminal (−) of the comparators (EA2~EA4), and a plurality of filed effect transistors (FET) (Q1~Q4) having gate terminals connected with output terminals of the comparators (EA2~EA4), drain terminals connected with anodes of LEDs provided in the LED module 20, respectively, and source terminals provided in serial to be connected with an output terminal of the LED module 20 (alternatively, drain terminals and source terminals may be connected with anodes and cathodes of LEDs provided in the LED module 20, respectively, according to the design of the circuit).

The driving of the circuit shown in FIG. 2 will be described as follows. When the electric voltage is supplied by the power supply module 10, each LED provided in the LED module 20 is luminous. The electric currents flowing to the LED module 20 are detected via the resistance (R1) that is the current detection module 30. The detected currents are compared with the first reference signal (Vref1) by the comparator (EA1) of the error amplification module 40 and the error signals amplified according to the result of the comparison are input to the comparators (EA2~EA4) of the sequential driving control modules 50, respectively.

Each of the comparators (EA2~EA4) provided in the sequential driving control module 50 compares the error signal amplified by the error amplification module 40 with the second preset reference signal (Vref2). When the error signal amplified by the error amplification module 40 is over the second reference signal (Vref2) based on the result of the comparison, a sequential driving control signal is output to switch off the FET (Q1~Q4) connected with the output terminal of each comparator (EA2~EA4) and electric currents are controlled to flow to both ends of the specific number of the LEDs provided in the LED module 20 to make the specific number of the LEDs luminous. When the error signal amplified by the error amplification module 40 is less than the second reference signal (Vref2) based on the result of the comparison, a sequential driving control signal is output to switch on the FETs (Q1~Q4) connected with the output terminal of each comparator (EA2~EA4) and electric currents flowing to both ends of the specific number of the LEDs provided in the LED module 20 are cut off.

In other words, when the electric voltages supplied to the LED module 20 by the power supply module 10 are heightened, the power is supplied to LED3, LED2 and LED1 connected with the sequential driving control module 50 according to the heightened voltages and LED3, LED2 and LED1 are sequentially luminous. When the voltages supplied to the LED module 20 by the power supply module 10 are lowered, the power is not supplied to LED1, LED2 and LED3 connected with the sequential driving control module 50 according to the lowered voltages and the corresponding LED1, LED2 and LED3 are not sequentially off.

Figure 3:
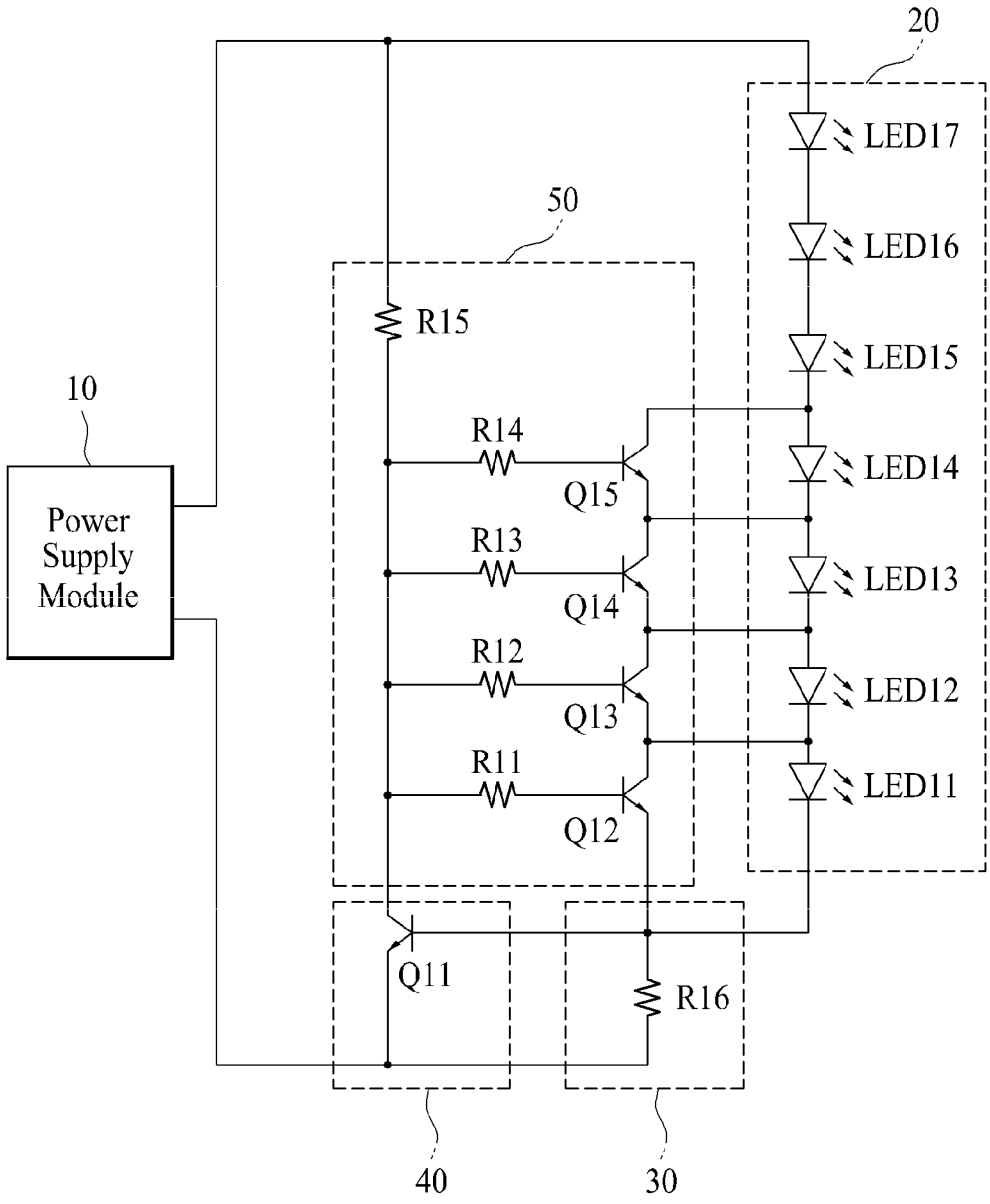

FIG. 3 is a diagram of a circuit illustrating an LED constant current driving apparatus according to another embodiment of the present invention. A current detection module 30 is configured of a resistance (R16) connected with an output terminal of a LED module 20 having a plurality of LEDs (LED1~LED17) connected in serial. An error amplification module 40 is configured of a transistor (Q11) having a base terminal connected with an output terminal of the current detection module 30, an emitter terminal connected with the power supply module 10 and a collector terminal connected with a sequential driving control module 50. A sequential driving control module 50 is configured of a plurality of transistors (Q12~Q15) having base terminals connected with an output terminal of the error amplification module 40 via a resistance (R11~R14) and collector terminals connected with anodes of LEDs provided in the LED module 20, respectively. An emitter terminal of a transistor Q12 is connected between an output terminal of the LED module 20 and an input terminal of the current detection module 30. Emitter terminals of transistors Q13, Q14 and Q15 are connected with collector terminals of transistor Q12, Q13 and Q14 in serial (Alternatively, collector terminals and emitter terminals of the transistors (Q12~Q15) are connected with anodes and cathodes of the LEDs provided in the LED module 20, respectively according to the design of the circuit).

The driving of the circuit shown in FIG. 3 will be described as follows. When supplied the electric power by the power supply module 10, the LEDs of the LED module 20 are luminous. Currents flowing to the LED module 20 are detected via the resistance (R16) that is the current detection module 30. When voltages detected via the currents detected by the current detection module 30 are over a reference voltage (a base-emitter voltage) of the transistor (Q11), the transistor (Q11) of the error amplification module 40 is driven, amplified and outputted. A voltage varied by the current amplified and outputted by the error amplification module 40 is inputted to a base terminal of each transistor (Q12~Q15) provided in the sequential driving control module 50.

At this time, the transistor (Q11) of the error amplification module 40 is an error amplifier that is a relative amplifier having a comparable voltage. Generally, a bias current has to flow to a transistor to enable a transistor to have an amplification degree with respect to an input voltage such as (0) or (−) voltage. As shown in FIG. 3, unless a bias voltage is supplied to the transistor Q11, the transistor Q11 is operated as an error amplifier having Vbe of a reference voltage. In other words, unless the input voltage (the current detected by the current detection module 30) is Vbe or more, a collector current may not flow. Once the input voltage is the Vbe voltage or more, the collector current may flow to be amplified. Accordingly, the transistor Q11 composing the error amplification module 40 is used as error amplifier.

When the voltage varied by the current amplified and outputted by the error amplification module 40 inputted to a base terminal of each transistor is less than a reference voltage of each transistor (Q12~Q15) (for example, a reference voltage of Q12 is Vbe of Q12 and a reference voltage of Q13 is Vbe of Vce+Q13 of Q12 and a reference voltage of Q14 is Vbe of Vce+Q14 of Vce+Q13 of Q12 and a reference voltage of Q15 is a Vbe of Vce+Q15 of Vce+Q4 of Vce+Q13 of Q12), each transistor (Q12~Q15) of the sequential driving control module 50 is off and both ends of specific LEDs provided in the LED module 20 to make the specific LEDs luminous. When the voltage input to the base terminal is over a reference voltage each transistor (Q12~Q15), each transistor (Q12~Q15) is on to cut off the current flowing to both ends of the specific LEDs provided in the LED module 20 and the specific LEDs are off.

In other words, when the power supplied to the LED module 20 by the power supply module 10 is heightened, the power is supplied to LED14, LED13, LED12 and LED11 connected with the sequential driving control module 50 according to the heightened voltage and LED14, LED13, LED12 and LED11 are sequentially luminous. When the power supplied to the LED module 20 by the power supply module 10 is lowered, the power is controlled not to be supplied to LED11, LED12, LED13 and LED14 connected with the sequential driving control module 50 according to the lowered voltage and the corresponding LED11, LED12, LED13 and LED14 are sequentially off.

Various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A constant current driving apparatus for an LED, comprising:

a power supply module configured to supply an electric power;

an LED module comprising one or more LEDs connected in serial, the LED module that is luminous by the power supplied by the power supply module;

a current detection module connected to an output terminal of the LED module, to detect a current flowing to the LED module;

an error amplification module configured to compare the current signal detected by the current detection module to a first preset signal and to amplify and output an error signal base on the result of the comparison; and a plurality of sequential driving control modules connected to the one or more LEDs provided in the LED module in serial, to compare the error signal amplified and outputted by the error amplification module with a second preset reference and to control luminosity and off driving of each LED provided in the LED module connected therewith by generating a sequential driving control signal based on the result of the comparison.

2. A constant current driving apparatus for an LED according to claim 1, wherein the plurality of the sequential driving control modules control driving of a specific LED by generating a sequential driving control signal for flowing an electric current to both ends of a specific LED provided in the LED module connected therewith, when the error signal amplified and outputted by the error amplification module is over the second preset reference signal, and the plurality of the sequential driving control modules control driving of a specific LED by generating a sequential driving control signal for flowing no electric current to both ends of a specific LED of the LED module connected therewith, when the error signal amplified and outputted by the error amplification module is less than the second reference signal.

3. A constant current driving apparatus for an LED according to claim 1, wherein the plurality of the sequential driving control modules are connected with the other LEDs except a predetermined number of LEDs capable of being luminous by the minimum voltage of the power supplied by the power supply module, and regardless of the luminosity or off driving performed by the sequential driving control modules, the predetermined number of the LEDs not connected with the sequential driving control modules are maintained to be luminous until the power supplied by the power supply module is stopped.

4. A constant current driving apparatus for an LED according to claim 1, wherein the number of the sequential driving control modules is freely adjustable according to setting the maximum voltage and the minimum voltage of the power supplied by the power supply module.

5. A constant current driving apparatus for an LED according to claim 1, wherein the current detection module includes a resistance connected to an output terminal of the LED module, and the error amplification module includes a comparator having an inverting terminal (−) connected to an output terminal of the current detection module and a non-inverting terminal (+) connected to a first reference signal, and the sequential driving control modules includes a plurality of comparators having non-inverting terminals (+) connected to an output terminal of the error amplification module and inverting terminals (−) connected to a second reference signal; a plurality of resistances for adjusting a voltage of the second reference signal connected to the inverting terminal (−) of the comparators; and a plurality of filed effect transistors (FET) having gate terminals connected to output terminals of the comparators, drain terminals connected to anodes of LEDs provided in the LED module, respectively, and source terminals provided in serial to be connected to an output terminal of the LED module.

6. A constant current driving apparatus for an LED comprising:

a power supply module configured to supply an electric power;

an LED module comprising one or more LEDs connected in serial, the LED module that is luminous by the power supplied by the power supply module;

a current detection module connected to an output terminal of the LED module, to detect a current flowing to the LED module;

an error amplification module including a transistor having a base terminal connected to an output terminal of the current detection module, an emitter terminal connected to the power supply module, a collector terminal connected to a sequential driving control module, to amplify and output a current signal detected by the current detection module when a current signal detected by the current detection module is over a reference voltage of the transistor; and a plurality of sequential driving control modules including a plurality of transistors having a base terminal connected to an output terminal of the error amplification module and a collector terminal connected to an anode of each LED provided in the LED module, to make a specific LED luminous by controlling a current to flow to both ends of a specific LED provided in the LED module when a voltage supplied to a base terminal of each transistor according to the current amplified and outputted by the error amplification module is lower than a reference voltage of each transistor and to switch off a specific LED by controlling a current flowing to both ends of a specific LED to be cut off when a voltage supplied to a base terminal of each transistor according to the current amplified and outputted by the error amplification module is over a reference voltage of each transistor.

* * * * *